US010215352B1

(12) United States Patent
Janczak

(10) Patent No.: US 10,215,352 B1
(45) Date of Patent: Feb. 26, 2019

(54) WOOD WICK IMITATION CANDLE

(71) Applicant: MerchSource, LLC, Irvine, CA (US)

(72) Inventor: Kristy Janczak, Irvine, CA (US)

(73) Assignee: MerchSource, LLC, Irvine, CA (US)

( * ) Notice: Subject to any disclaimer, the term of this patent is extended or adjusted under 35 U.S.C. 154(b) by 0 days.

(21) Appl. No.: 15/395,828

(22) Filed: Dec. 30, 2016

Related U.S. Application Data

(60) Provisional application No. 62/273,217, filed on Dec. 30, 2015.

(51) Int. Cl.

| | |
|---|---|
| ***F21S 6/00*** | (2006.01) |
| ***F21S 9/02*** | (2006.01) |
| ***H04R 1/02*** | (2006.01) |
| ***F21S 10/04*** | (2006.01) |
| ***H05B 37/02*** | (2006.01) |

(52) U.S. Cl.
CPC ..... *F21S 10/04* (2013.01); *F21S 6/001* (2013.01); *F21S 9/02* (2013.01); *H04R 1/028* (2013.01); *H05B 37/0272* (2013.01)

(58) Field of Classification Search
None
See application file for complete search history.

(56) References Cited

U.S. PATENT DOCUMENTS

| | | | | |
|---|---|---|---|---|
| 9,664,349 | B1 * | 5/2017 | Hurduc | F21S 10/046 |
| 2004/0009447 | A1 * | 1/2004 | Decker | F23D 14/16 431/288 |
| 2014/0211499 | A1 * | 7/2014 | Fong | F21S 6/001 362/558 |

OTHER PUBLICATIONS https://woodwick.yankeecandle.com/wbrowse/candles/woodwick-sale-fragrances/_/N-bdg?Nr=AND%28OR%28product.siteId%3AWWSite%29%2Cproduct.language%3AEnglish%2Cproduct.priceListPair%3Aplist290003_plist290002%29&view=Grid; retrieved from from Internet on Oct. 15, 2018; 5 pp.

* cited by examiner

*Primary Examiner* — Britt D Hanley
(74) *Attorney, Agent, or Firm* — Avyno Law P.C.

(57) ABSTRACT

A decorative, imitation candle is provided that simulates a lighted wood or wood-like wick by covering the lighting element, such as a LED, under or within a wood-like wick. Optionally, an electronic chip may be connected to a power source to provide sounds of wood burning or crackling when the lighting element is operating, and/or may be operated by remote control.

10 Claims, 2 Drawing Sheets

WOOD WICK IMITATION CANDLE

RELATED APPLICATIONS

This application claims priority of U.S. Application Ser. No. 62/273,217, filed on Dec. 30, 2015, titled WOOD WICK CANDLE, which application is incorporated in its entirety by reference in this application.

BACKGROUND OF THE INVENTION

1. Field of the Invention

The present invention relates to candles, and, in particular, flameless candles having a wood wick housing covering a light source to simulate a lighted wood wick.

2. Related Art

Candles produce both necessary and pleasurable effects. Flameless candles offer a safe means in contrast to traditional candles because they are often illuminated by a small bulb or LED rather than an open flame and pose less threat or a fire hazard, since the candle can be left unattended. The risk of open flames has caused many state and local governments to outlaw traditional candles inside public spaces, and many families have removed them from their homes. In addition to safety factors, the ease and convenience of operation and the reduced cost of flameless candles compared to traditional candles makes them an attractive alternative. Moreover, flameless candles are more environmentally friendly than traditional open flame candles, which release harmful toxins and oils into the air. Flameless candles also last for years, meaning that the user does not have to replace them constantly following use, which creates less waste.

Various types of flameless candles exist, including tea candles, votive candles, pillar candles or other types of candles. Flameless candles can simulate the flickering effect of a real candle without the danger of an open flame. Some such techniques are described in U.S. Pat. No. 6,616,308, Flameless candles may include various parts, including a lamp, battery contacts and a switch. Some may even be operated by remote control devices.

One drawback of flameless candles is that the lamp, bulb or LED is not that attractive does not provide a realistic flame appearance. Thus, a need still exists for flameless candles that have more realistic wick appearances.

SUMMARY

The present invention is a flameless or imitation candle having a housing made of wax or other substance to imitate a candle body. The top of the housing includes an imitation wood wick extending outwardly from the housing and covering a light element supported by the housing. The imitation candle further includes an energy source operably connected to the light element in the housing. While the wick is called "wood or wooden" for purposes of this application, the wick can be made from any material giving the appearance of wood, including, but not limited to, a plastic.

Optionally, a sound card or chip may be located in the housing to produce a sound effect when the candle is illuminated to provide a more realistic effect. The sound may be, for example, the sound of wood burning or "crackling" when the power is turned on. In addition, the housing may contain a receiver and microprocessor to permit operation by remote control.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
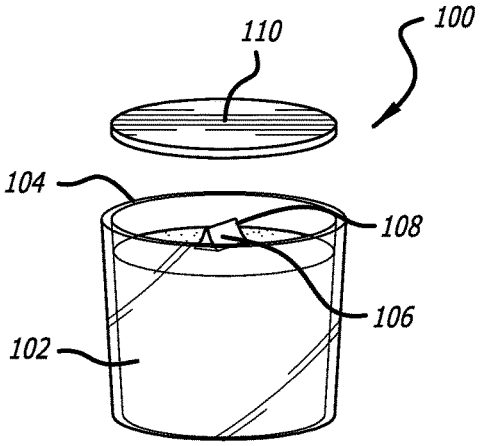
FIG. 1 illustrates a side perspective view of one example of an implementation of an imitation candle of the invention.
Figure 2:
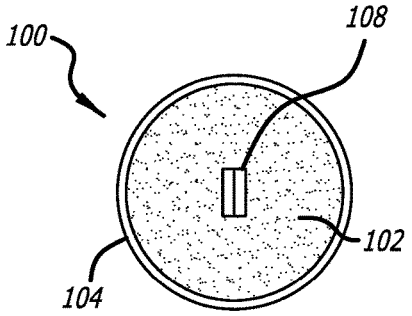
FIG. 2 is a top view of the imitation candle of FIG. 1.

FIG. 1 illustrates the side perspective view of one example of an implementation of imitation candle of the invention 100. FIG. 2 is a top view of the imitation candle 100 of FIG. 1.

As illustrated in FIGS. 1 and 2, the present invention includes, in its simplest form, a housing 102 that resembles a candle. The housing 102 can be made of wax or any material suitable for providing a wax-like or candle-like appearance. The housing 102 can be standalone or positioned within a container 104, like the illustrated example. The housing 102 contains standard electrical components commonly found in an imitation candle (not shown). A light source 106 is provided near the top of the housing 102. The light source 106 may be, for example, an LED, mini-LED or other light source. The light source 106 may be positioned on the top surface of the housing 102 or may be recessed in the top surface of the housing 102. A wood or wood-like wick 108 is then positioned on the top of the housing 102, over the light source 106, to create the appearance of a wood wick. The wood or wood-like wick 108 may be constructed of wood or any other material, e.g. plastic, capable of giving the wick a wood-like appearance. The candle may be a stand-alone candle or positioned within a container. When in a container, a lid, such as a wood fitted lid 110, may also be provided that may rest on top of the container 104.

Figure 3:
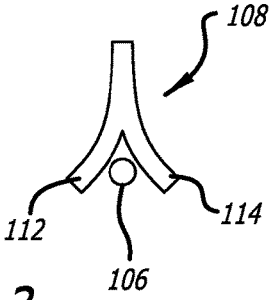
FIG. 3 illustrates a side view of one example of a wood wick of the invention.

FIG. 3 illustrates a side view of one example the wood or wood-like wick 108 of the invention that simulates the appearance of a lit wood wick in a candle. The wood or wood-like wick 108, which may be between 1 and 3 cm tall and 1 to 3 cm wide (with 1.2 cm height and 1.2 cm width being optimal), is inserted into the wax or wax-like housing 102 above the light source 106, where it extends upwardly from the top of the housing 102. The wood or wood-like wick comprises two pieces 112 and 114 of thin veneer glued together at their tops. As seen in the side view of FIG. 3, the two pieces 112 and 114 are angled (i.e., angled sides) such that they are spaced apart at their base and come together and touch at the top, creating space between the pieces at the bottom for receiving the light source 106. The light source 106 is supported by the wax or wax-like housing 102 near the base of the wick 108.

The wood or wood-like wick 108 is shaped to hide the light source or lighting element 106. The lighting element 106 is in electrical communication with a power source (not shown) that may be placed at the base of housing 102 or other location within the housing 102. The power source may be batteries or be an AC power source. When electricity is provided by the power source to the lighting element 106, i.e., the power is turned "on," the wood or wood-like wick 108 appears "lit." The electricity may be supplied in varying intensities to provide a simulation of a flickering wick.

Optionally, an electronic chip (not shown) that produces sound may be provided in the housing 102 in electrical connection with the power source to provide sounds such as that of wood burning or "crackling" when the power is turned on. A speaker (not shown) may further be provided in the housing 102 to produce the sound. In addition, the flameless candle 100 may be operable by remote control, and if so, the housing 102 will be equipped with an appropriate device (not shown) to receive a signal sent remotely and a microprocessor.

The example illustrated in FIGS. 1-3 shows an imitation wax candle 100 operated by three AAA batteries. A microchip with a crackling sound speaker is stored in the base of the candle 100. The light source 106 is nestled between the wood or wood-like wick 108, thereby giving the illusion of a flickering candle. In the provided example, the candle 100 includes a timer, e.g., a four (4) hour timer, with a slider switch at the bottom (not shown).

The wax or wax-like housing 102 may be placed in a container 104, which may be made of glass or other translucent material, such as plastic. In the illustrated example, the container 104 is a 4"H×4" diameter (base is 3.5") jar. The wax or wax-like housing 102 begins 1" from the top of the container 104.

Figure 4:
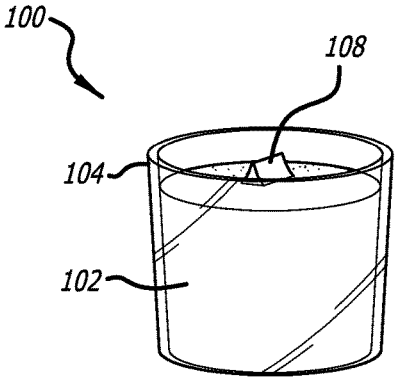
FIG. 4 illustrates another side perspective view of one example of the imitation candle of the invention.
Figure 5:
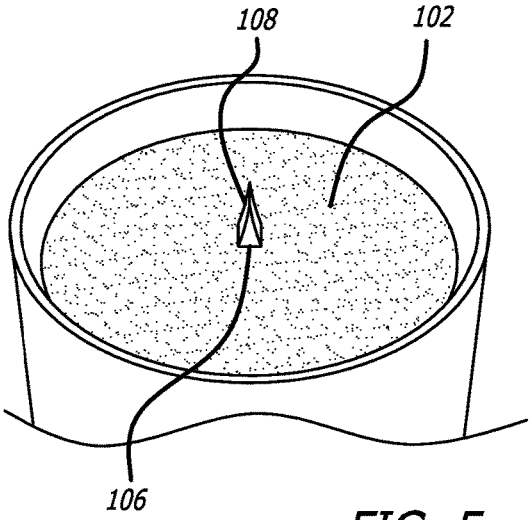
FIG. 5 illustrates a close-up of the top of the imitation candle of FIG. 4 showing the wood wick.

FIGS. 4 & 5 illustrate additional side perspective views of one example of the imitation candle 100 of the invention. FIG. 4 illustrates a container 104 made of glass having a flameless candle housing 102 within the container 104. FIG. 5 illustrates the appearance of the wood or wood-like wick 108 used in connection with imitation candle of the invention 100. As discussed above, in this example, two wood veneers 112 and 114 are glued together at the top covering a light source 106, e.g. LED, that is located near the base of the wood or wood-like wick 108. In the alternative, the two wood veneers 112 and 114 may be one piece that is bent is half to and folded where the fold creates the top point of the wood wick 108 and the ends create the base, positioned on the candle housing 102 separated apart to create a housing for the LED 108 as shown in FIG. 3.

Figure 6:
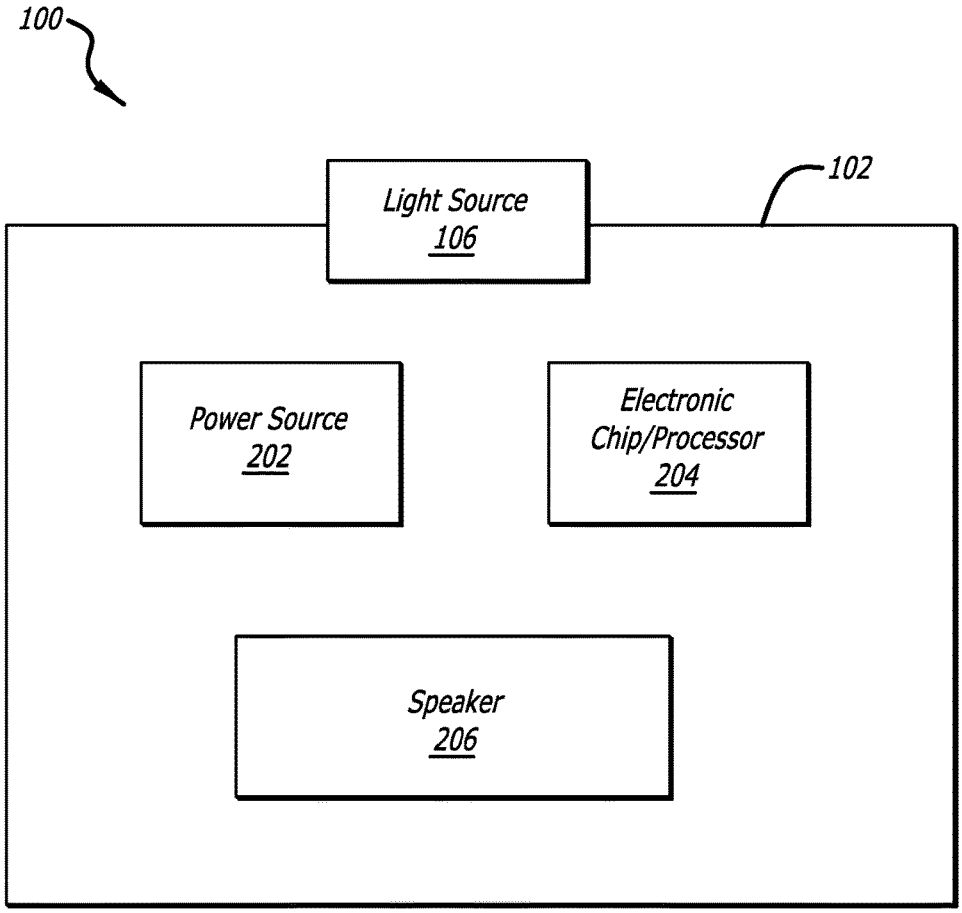
FIG. 6 is a block diagram showing example components of the candle.

FIG. 6 is a block diagram showing example components of the candle 100. Within the housing 102 may be a power source 202. Optionally, the power source may be located outside of the housing. The power source 202 may be batteries or may be an AC power source. Optionally, an electronic chip or processor 204 that produces sound or that controls the lighting element may be provided in the housing 102 in electrical connection with the power source to provide sounds such as that of wood burning or "crackling" when the power is turned on and/or to control the light (e.g., flicker effect, timing of the light). A separate processor or electronic chip may also be provided where one controls the sound and the other controls the light. A speaker 206 may further be provided in the housing 102 to produce the sound. A receiver or transceiver 208 may also be provided to allow the candle 100 to be operable by remote control.

The example illustrated in FIGS. 1-6 shows an imitation wax candle 100 operated by three AAA batteries. A microchip with a crackling sound speaker is stored in the base of the candle 100. The light source 106 is nestled between the wood or wood-like wick 108, thereby giving the illusion of a flickering candle. In the provided example, the candle 100 includes a timer, e.g., a four (4) hour timer, with a slider switch at the bottom (not shown).

While the invention is shown in only a few of its forms, it is not thus limited but is susceptible to various changes and modifications without departing from the spirit and scope of the invention.

What is claimed is:

1. An imitation candle comprising:

(a) a housing that simulates a candle, where the housing has a top surface;

(b) an imitation wood or wood-like wick extending outwardly from the top of the housing;

(c) a lighting element positioned on the top surface of the housing underneath the wick, where some parts of the lighting element are partially covered by the wick while other parts of the lighting element are fully exposed and can be directly viewed from outside the housing; and (d) a power source for the lighting element in the housing.

2. The imitation candle of claim 1, further comprising an electronic sound chip configured to mimic the sound of burning wood and a speaker for producing the sound.

3. The imitation candle of claim 1 wherein the lighting element is a light emitting diode.

4. The imitation candle of claim 3 wherein the power source is one or more batteries.

5. The imitation candle of claim 1, further comprising a receiver and a microprocessor for receiving and processing remote control signals.

6. An imitation candle comprising:

(a) a housing that simulates a candle, where the housing has a top surface;

(b) a non-circumferential imitation wood or wood-like wick extending outwardly from the top of the housing where the non-circumferential imitation wood or wood-like wick includes two angled sides spaced apart at their base for receiving a light source;

(c) a light source supported by the housing underneath the wick within the spaced apart base of the wick; and (d) a power source for the lighting element in the housing.

7. The imitation candle of claim 1 where the imitation wood or wood-like wick is non-circumferential.

8. The imitation candle of claim 1 where the imitation wood or wood-like wick includes two angled sides spaced apart at their base and touching at their top.

9. The imitation candle of claim 6 where the lighting element is positioned on the top surface of the housing underneath the wick, where opposite sides of the lighting element are fully exposed and can be directly viewed from outside the housing.

10. The imitation candle of claim 6 where the lighting element is positioned on the top surface of the housing underneath the wick, where opposite sides of the lighting element are covered by each angled side of the wick.

* * * * *